US007287409B2

(12) United States Patent
Shiroza et al.

(10) Patent No.: US 7,287,409 B2
(45) Date of Patent: Oct. 30, 2007

(54) DIE CUSHION DEVICE

(75) Inventors: Kazuhiko Shiroza, Ishikawa (JP); Yukiyoshi Takayama, Ishikawa (JP); Hiroaki Honma, Ishikawa (JP); Seiji Seki, Ishikawa (JP)

(73) Assignees: Komatsu Ltd., Tokyo (JP); Komatsu Industrial Corp., Tokyo (JP)

( * ) Notice: Subject to any disclaimer, the term of this patent is extended or adjusted under 35 U.S.C. 154(b) by 47 days.

(21) Appl. No.: 11/152,161

(22) Filed: Jun. 15, 2005

(65) Prior Publication Data

US 2005/0279151 A1 Dec. 22, 2005

(30) Foreign Application Priority Data

Jun. 18, 2004 (JP) ..... 2004-181102

(51) Int. Cl.
*B21D 22/21* (2006.01)

(52) U.S. Cl. ..... 72/351; 72/453.13; 72/465.1; 267/119; 267/130

(58) Field of Classification Search ..... 72/350, 72/351, 453.13, 465.1; 267/119, 130
See application file for complete search history.

(56) References Cited

U.S. PATENT DOCUMENTS 2,233,164 A * 2/1941 Glasner ..... 72/455
5,435,166 A * 7/1995 Sunada ..... 72/351

FOREIGN PATENT DOCUMENTS

JP 06-000543 1/1994
JP 06-000544 1/1994

* cited by examiner

*Primary Examiner*—Dmitry Suhol
(74) *Attorney, Agent, or Firm*—Posz Law Group, PLC; R. Eugene Varndell, Jr.

(57) ABSTRACT

A die cushion device is comprised of die cushion modules which are independently movable and unitized. The individual die cushion modules are provided with a cushion pad, a servomotor, a power transmission mechanism, a power conversion mechanism and a guide member. By configuring in this way, the design of the die cushion is facilitated, a drive mechanism of the die cushion becomes compact, and the number of types of parts used is decreased.

9 Claims, 10 Drawing Sheets

DIE CUSHION DEVICE

BACKGROUND OF THE INVENTION

1. Field of the Invention

The present invention relates to a die cushion device of a press machine which drives up and down a cushion pad by a servomotor.

2. Description of the Related Art

The press machine is provided with a die cushion device (hereinafter simply called as the die cushion) which is used to suppress wrinkles during drawing. A conventional die cushion produces a cushion pressure while driving up and down a cushion pad by using a hydraulic pressure or an air pressure. To enhance drawability of the press machine and to prevent a work from being broken or distorted, it is necessary to control the cushion pressure of the die cushion with high accuracy, especially it is necessary to control the cushion pressure with high accuracy when the cushion pad is moved downward.

The die cushion using an air pressure only cannot control the cushion pressure very accurately when the cushion pad operates. The die cushion using a hydraulic pressure can control the cushion pressure very accurately by controlling a pressure oil when the cushion pad operates. But, the hydraulic equipment has drawbacks that its structure is complex, and precise maintenance and control are required. Therefore, the die cushion provided with an electric servomotor having a simple structure and not requiring precise maintenance or control is receiving attention in these years.

Japanese Patent Application Laid-Open No. 6-544 (hereinafter called as "patent literature 1") discloses a die cushion which is provided with a rotary electric servomotor. This die cushion is generally comprised of a cushion pad and a drive mechanism which drives the cushion pad. The drive mechanism is generally comprised of a servomotor and a power transmission mechanism which transmits the power of the servomotor to the cushion pad. The power transmission mechanism is generally comprised of a support rod, a rack and a pinion.

A support rod is connected to the bottom surface of the cushion pad, and the rack is connected to the lower part of the support rod. The cushion pad, the support rod and the rack are integrally movable up and down. The pinion is occluded to the rack, and the pinion is coupled to the rotation shaft of the servomotor. The servomotor is supplied with an electric current to rotate the rotation shaft, the pinion is rotated, and the rotation of the pinion causes the rack to move up and down. The support rod and the cushion pad also move up and down together with the rack.

Japanese Patent Application Laid-Open No. 6-543 (hereinafter called as "patent literature 2") discloses a die cushion which is provided with a rotary electric servomotor in the same manner as in the patent literature 1. The cushion pad described in the patent literature 2 is divided into plural portions, and the individual divided cushion pads are coupled to the servomotor via a rack and pinion mechanism and a train of reduction gears. And, the individual servomotors are controlled to move up and down the cushion pads.

The size of the cushion pad and the ability of the die cushion are determined according to the request of the user. Therefore, the die cushion is designed according to the specifications as required. And, it is natural to change a design of a drive mechanism depending on a limitation of *a mounting space* of the cushion pad and the press machine, and there are many occasions that the engineering change to the bed frame is forced. Therefore, the design man-hours increase in the die cushion production stage.

For example, the die cushions disclosed in the patent literature 1 and the patent literature 2 have a drive mechanism which is large in structure in the vertical and horizontal directions. If this drive mechanism cannot be housed, it becomes necessary to make engineering changes or the like of the drive mechanism in the *mounting space* allowed by the user. Then, it becomes necessary to have the above-described number of design man-hours.

The die cushion disclosed in the patent literature 2 has each of the plural divided cushion pads independently controlled by the servomotors. Because the cushion pads are divided, the cushion pressure can be changed partly, and it is advantageous. But, the dividing parts of the cushion pad are determined according to a request by the user, so that they are different among the individual die cushions. In other words, it is necessary to design the die cushion according to the specifications as required. In this connection, it can be said that the number of man-hours to design the die cushion increases as described above.

Besides, a high capacity die cushion requires a large drive mechanism. As a result, the component elements of the drive mechanism increase. Then, types of used parts increase, then it becomes necessary to manage the various parts, and the management cost increases.

As described above, the production of a conventional die cushion may have problems that the number of man-hours to design increases and the cost becomes high.

The present invention has been made in view of the above circumstances and provides a die cushion device which is inhibited the increase of the number of types of used parts by facilitating the design of the die cushion and miniaturizing the drive mechanism of the die cushion.

SUMMARY THE INVENTION

A first aspect of the present invention is a die cushion device, comprising a unitized die cushion module, which is comprised of a cushion pad which is movable up and down within a bed; a servomotor which is an up-and-down drive source of the cushion pad; a power conversion mechanism which converts a rotary motion of the servomotor into an up and down movement of the cushion pad; a power transmission mechanism which transfers the rotary motion from the rotation shaft of the servomotor to the power conversion mechanism; and a guide member which guides the cushion pad in up and down directions, wherein one working station of the bed is provided with one or more of the die cushion module.

According to the first aspect of the present invention, the die cushion device is comprised of the die cushion modules which are independently drivable and unitized. The individual die cushion modules are provided with the cushion pad, the servomotor, the power transmission mechanism, the power conversion mechanism and the guide member. By configuring in this way, the die cushion of one working station comprises a combination of the die cushion modules which are standardized units. Where the die cushion is designed, the die cushion modules may be combined simply. In case of an engineering change, the combination can be changed simply to comply with the change. Thus, the design of the die cushion is facilitated by virtue of the die cushion modules, and the number of man-hours to design is decreased.

The capacity of the die cushion module is arbitrary. Therefore, when the capacity of the die cushion module is decreased, the drive mechanism becomes small, and the number of types of parts used is decreased. Meanwhile, the die cushion with a high capacity can be formed by combining plural small-capacity die cushion modules. In other words, the die cushion with a high capacity can be realized by the die cushion modules having a small drive mechanism. Thus, the number of type of parts is decreased by using the die cushion modules, and the parts management cost is reduced.

Fine adjustment of the size in agreement with the design of the press machine can be made by adjusting the size of the top plate which is disposed on the top surface of the cushion pad.

A second aspect of the present invention is the die cushion device according to the first aspect of the invention, wherein the cushion pad, the servomotor, the power conversion mechanism and the power transmission mechanism are arranged to include all projected images of the servomotor, the power conversion mechanism and the power transmission mechanism, which are presumed when projected from vertically above to a lower horizontal surface, into the projected image of the cushion pad which is presumed when similarly projected from vertically above to a lower horizontal surface.

According to the second aspect of the present invention, all projected images of the servomotor, the power conversion mechanism and the power transmission mechanism are included in the projected image of the cushion pad which is presumed when projected from vertically above to a lower horizontal surface. By configuring in this way, the housing area of the drive mechanism in the horizontal direction does not become larger than the top surface area of the cushion pad. Therefore, the die cushion modules can be combined without suffering from the influence of the drive mechanism, and the flexibility of the die cushion is increased.

A third aspect of the present invention is the die cushion device according to the first aspect of the invention, wherein a rib is disposed between the opposite wall surfaces of the one working station, and the die cushion pads are adjacent to each other with the rib between them.

According to the third aspect of the invention, where the plural die cushion modules are combined, there is provided the rib which is provided between the opposed wall surfaces of the one working station of the bed. The individual cushion pads are housed into the spaces which are partly divided by the individual ribs and beds. Therefore, the cushion pads are adjacent to each other with the rib between them. By configuring in this way, the cushion pad becomes absent above the rib. Therefore, it is desirable to dispose a size larger top plate on the top surface of the cushion pad to cover the top of the rib. When the rib is provided, a warp of a cushion plate which is disposed on the top surface of the cushion pad can be reduced.

A fourth aspect of the present invention is the die cushion device according to the first aspect of the invention, wherein the power conversion mechanism includes a ball screw mechanism.

According to the fourth aspect of the invention, the power transmission mechanism includes the ball screw mechanism which is comprised of a nut portion and a thread portion. Where the nut portion of the ball screw is directly connected to the power transmission mechanism, the thread portion moves up and down. Conversely, where the thread portion of the ball screw is directly connected to the power transmission mechanism, the nut portion moves up and down.

The ball screw mechanism has the center of axis of a rotation member and the center of axis of an up-and down member on the same axis, so that the projected images of the servomotor, the power conversion mechanism and the power transmission mechanism which are presumed when projected from vertically above to a lower horizontal surface can be made small with ease.

It is assumed that a screw and nut mechanism is included in the ball screw mechanism because it is comprised of the nut portion and the thread portion. The ball screw mechanism does not have a large friction loss, the screw and nut mechanism using a trapezoidal screw thread can transmit high torque, and the screw and nut mechanism using a triangular screw thread has an intermediate effect between them.

DETAILED DESCRIPTION OF THE INVENTION

Embodiments of the present invention will be described below with reference to the drawings.

Figure 1:
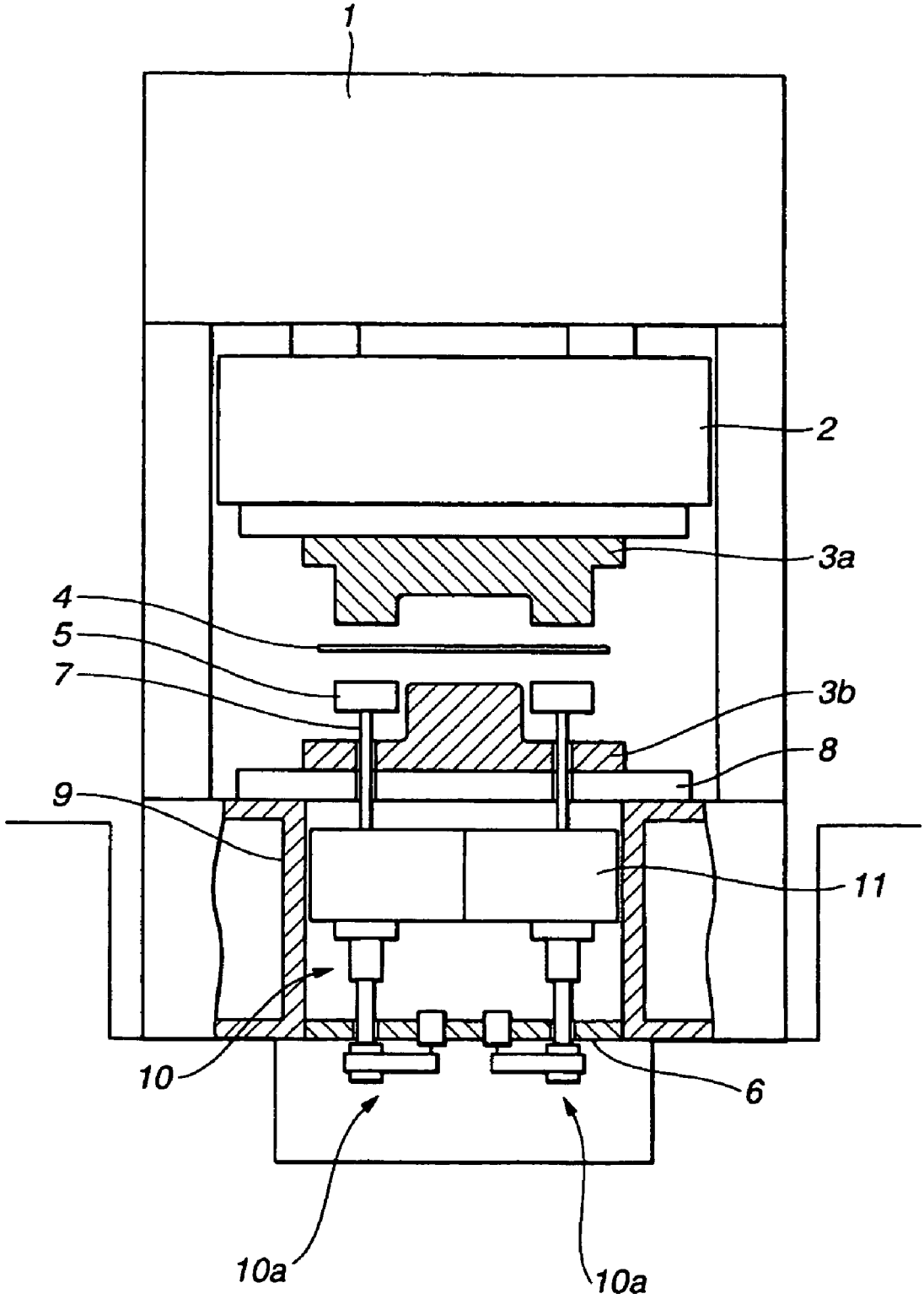
FIG. 1 is a schematic view showing a structure of a press machine.

FIG. 1 is a schematic view showing a structure of a press machine.

In the press machine, a slide 2 which is positioned above and a bolster 8 which is positioned below are disposed to oppose each other. The slide 2 is vertically moved by the power received from an above slide drive mechanism 1. An upper die 3*a* is attached to the bottom of the slide 2. Meanwhile, the bolster 8 is fixed to the top of a bed 9, and a lower die 3*b* is attached to the top of the bolster 8. Plural holes are formed vertically through the bolster 8 and the lower die 3*b*. Cushion pins 7 are inserted through these holes. The top ends of the cushion pins 7 are contacted to the bottoms of blank holders 5 which are disposed in a recessed part of the lower die 3*b*. The bottom ends of the cushion pins 7 are contacted to cushion pads 11, which are disposed within the bed 9, of die cushion modules 10*a*. A beam 6 is disposed between inside wall surfaces of the bed 9 to support the die cushion modules 10*a* by the beam 6. A die cushion 10 is comprised of one or more die cushion modules 10*a*.

FIRST EMBODIMENT 1

Figure 2:
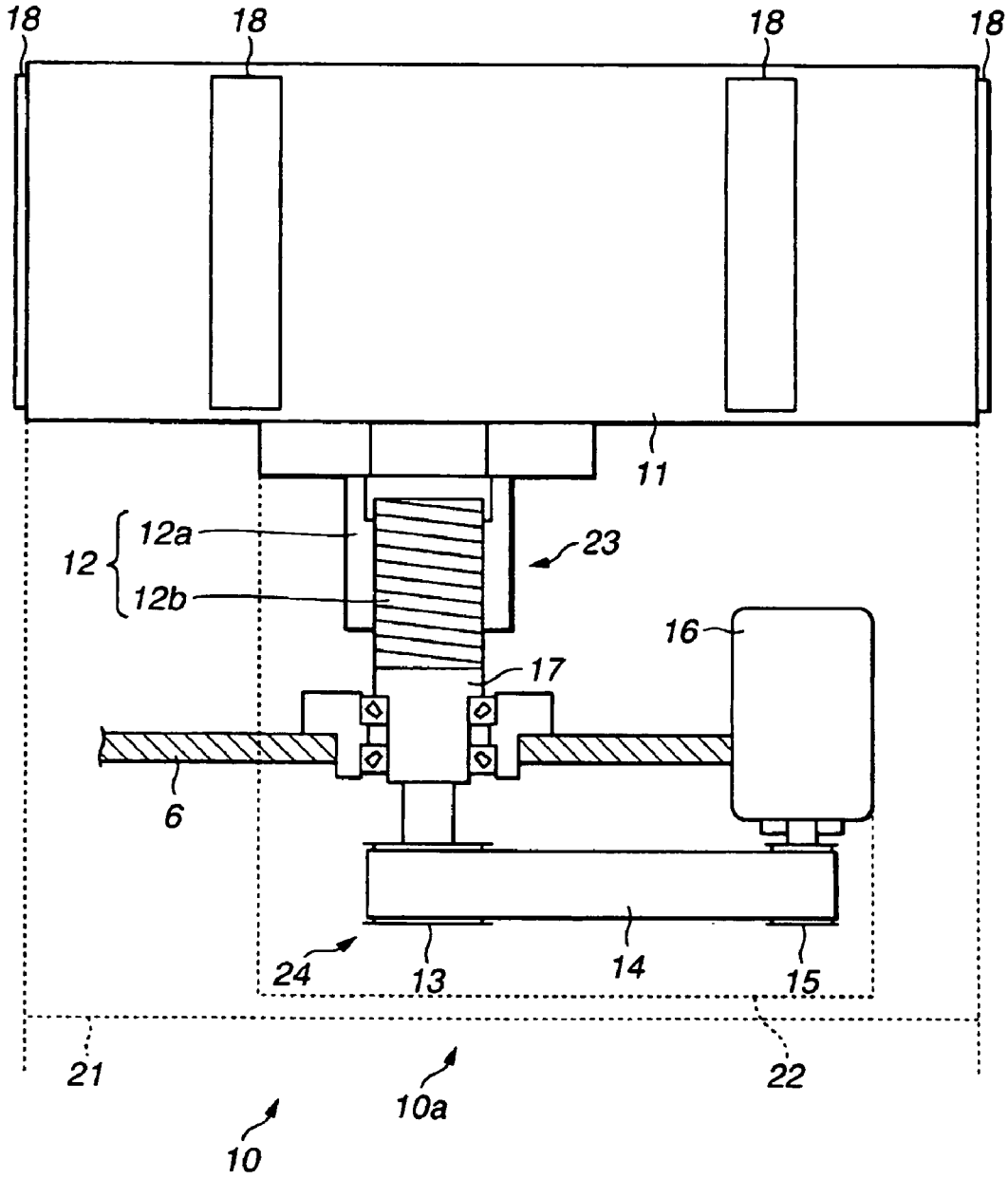
FIG. 2 is a schematic view showing a die cushion according to a first embodiment.
Figure 3A:
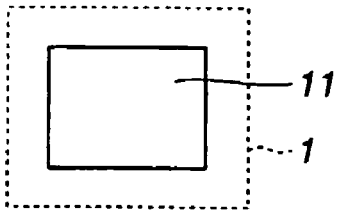
FIG. 3A through FIG. 3D are simplified plan views of one working station.
Figure 3B:
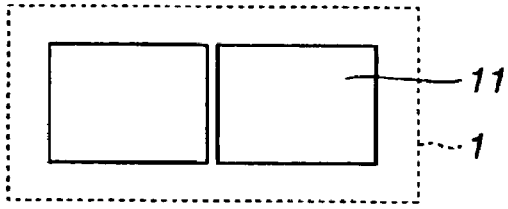
Figure 3C:
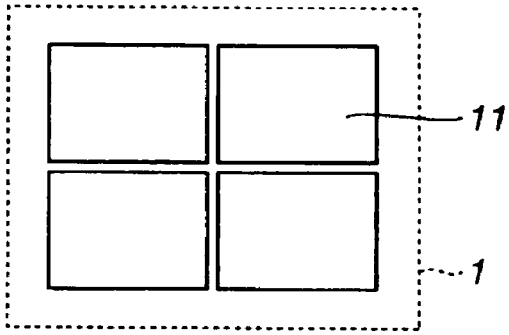
Figure 3D:
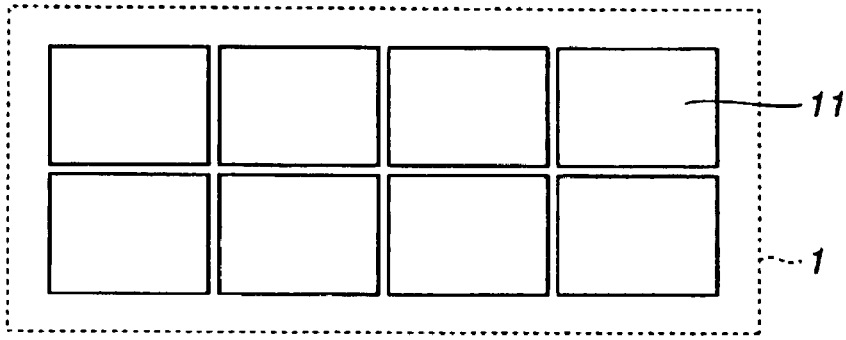

FIG. 2 is a schematic view of a die cushion according to a first embodiment.

In the die cushion module 10*a*, the cushion pad 11 is coupled to the rotation shaft of a servomotor 16 via a ball screw 12, a coupling member 22, a large pulley 13, a belt 14 and a small pulley 15. The power is mutually transferable between the cushion pad 11 and the servomotor 16. A nut portion 12*a* of the ball screw 12 is coupled to the bottom of the cushion pad 11. A thread portion 12*b* of the ball screw 12 is screwed into the nut portion 12*a*. The lower part of the thread portion 12*b* is connected to a coupling member 17. The coupling member 17 is rotatably supported in the beam 6 by a bearing or the like. And, its lower part is coupled to the large pulley 13. The small pulley 15 is connected to the rotation shaft of the servomotor 16. The belt 14 is wound around the large pulley 13 and the small pulley 15 to make the power transferable between them.

The rotary servomotor 16 has a rotation shaft, and the rotation shaft rotates normally or reversely depending on the supply of an electric current. When the servomotor 16 is supplied with an electric current to rotate the rotation shaft, the small pulley 15, the large pulley 13, the coupling member 17 and the thread portion 12*b* are rotated. When the thread portion 12*b* is rotated, the nut portion 12*a* is moved linearly in the vertical direction along the thread portion 12*b*, namely in up and down directions. Then, the cushion pad 11 moves up and down together with the nut portion 12*a*. The bottom end of the nut portion 12*a* is held above from the bottom end of the coupling member 17 regardless of the up and down movements of the nut portion 12*a*. A pushing force given to the cushion pad 11, namely a cushion pressure produced in the cushion pad 11 is controlled by controlling the current given to the servomotor 16.

In this embodiment, mechanisms which convert the rotary motion of the servomotor 16 into the linear movement of the cushion pad 11 and related to the linear movement of the cushion pad 11, namely the ball screw 12 and the coupling member 17 are called as a power conversion mechanism 23, and mechanisms which transfer the rotary motion of the servomotor 16 to the power transmission mechanism 23, namely the large pulley 13, the belt 14 and the small pulley 15 are called as a power transmission mechanism 24.

Guide plates 18 are disposed on each side of the cushion pad 11. Guide plates 18 (not shown) are also disposed on each inside wall surface of the bed 9 to be mutually slidable with the guide plates 18 of the cushion pad 11. Where two cushion pads 11 are adjacent to each other to mutually oppose their sidewalls, the individual guide plates 18 are mutually slidable. Thus, the cushion pad 11 is guided in the vertical direction by the guide plates which are disposed on the four sidewalls of the cushion pad 11.

Then, the positional relationship of the drive mechanism which is comprised of the cushion pad 11, the servomotor 16 and the like will be described.

First, it is assumed that a first projected image 21 is formed by projecting from vertically above of the cushion pad 11 to a lower horizontal surface. It is also assumed that a second projected image 22 is formed by projecting from vertically above of the servomotor 16, the power conversion mechanism 23 and the power transmission mechanism 24 to a lower horizontal surface. And, the cushion pad 11 and its drive mechanism are arranged such that the second projected image 22 is entirely included in the first projected image 21. By arranging in this way, a *mounting space* in the horizontal direction of the die cushion module 10*a* does not become larger than the top surface area of the cushion pad 11. In other words, even if the cushion pads 11 are disposed adjacent to each other, the drive mechanisms which are below the individual cushion pads 11 do not interfere with each other, and it becomes possible to dispose the plural die cushion modules 10*a* next to one working station.

In FIG. 2, if the downward projected images of the servomotor 16, the belt 14 and the small pulley 15 are outside of the first projected image 21, the adjacent die cushion modules 10*a* can be disposed closer to each other by varying the height of the belt 14 or exchanging the positions of the servomotors 16. Thus, the area of the cushion pad 11 of the individual die cushion modules 10*a* can be decreased further more, the arrangement of the die cushion modules 10*a* is facilitated, and the arrangement flexibility is increased.

FIG. 3A through FIG. 3D are simplified plan views of one working station. One die cushion module 10*a* is disposed on one working station of the press machine in FIG. 3A, two die cushion modules 10*a* are disposed on one working station of the press machine in FIG. 3B, four die cushion modules 10*a* are disposed on one working station of the press machine in FIG. 3C, and eight die cushion modules 10*a* are disposed on one working station of the press machine in FIG. 3D.

Here, the arrangement of the die cushion modules 10*a* will be described with reference to an example of the arrangement of four die cushion modules 10*a* on one working station.

Figure 4:
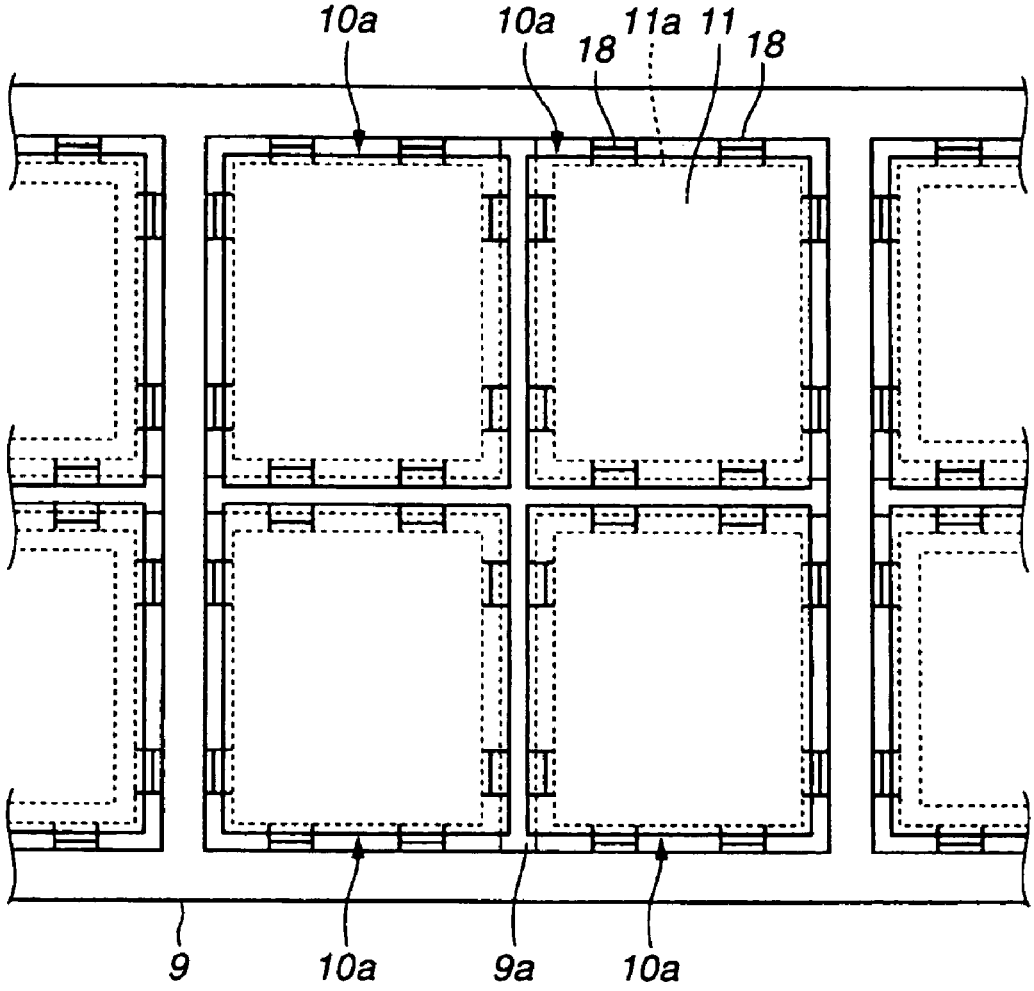
FIG. 4 is a plan view of one working station.
Figure 5:
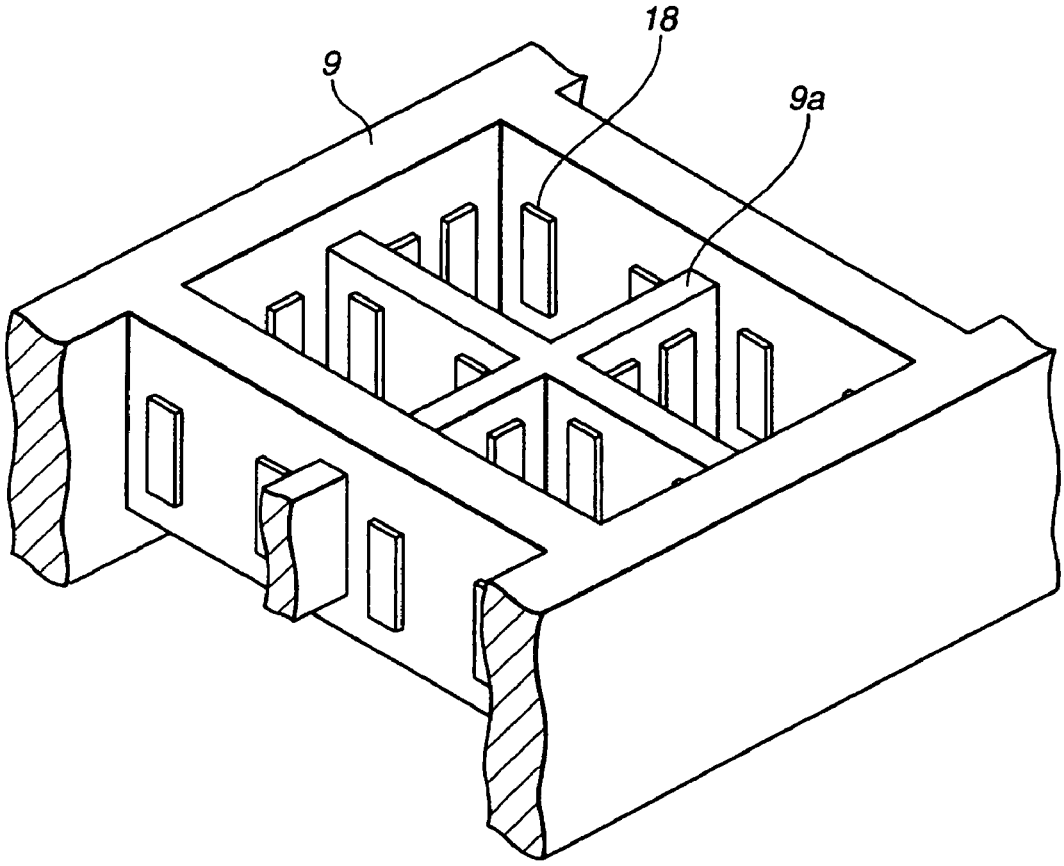
FIG. 5 is a perspective view of one working station viewed obliquely from above.

FIG. 4 is a plan view of one working station. FIG. 5 is a perspective view of one working station viewed obliquely from above.

As shown in FIG. 5, the bed 9 has a vertical rib 9*a* which is disposed between the opposite inside wall surfaces to divide the single working station into plural spaces. The guide plates 18 are disposed on the inside wall surfaces of the bed 9 and the wall surfaces of the vertical rib 9*a*. In FIG. 4, the die cushion modules 10*a* are adjacent to each other with the vertical rib 9*a* between them. According to this structure, the cushion pad 11 is supported its four sides by the bed 9 via the guide plates 18. By configuring in this way, the looseness of the cushion plates 18 is decreased, but the cushion pins 7 cannot be disposed on the vertical rib 9*a*. Therefore, a top plate 11*a* is disposed on the top surface of the cushion pad 11, and the vertical rib 9*a* is also covered from above by the top plate 11*a*.

Thus, by configuring with the vertical rib 9*a* disposed, a warp of the cushion plate which is disposed on the top surface of the cushion pad 11 can be decreased.

Figure 6:
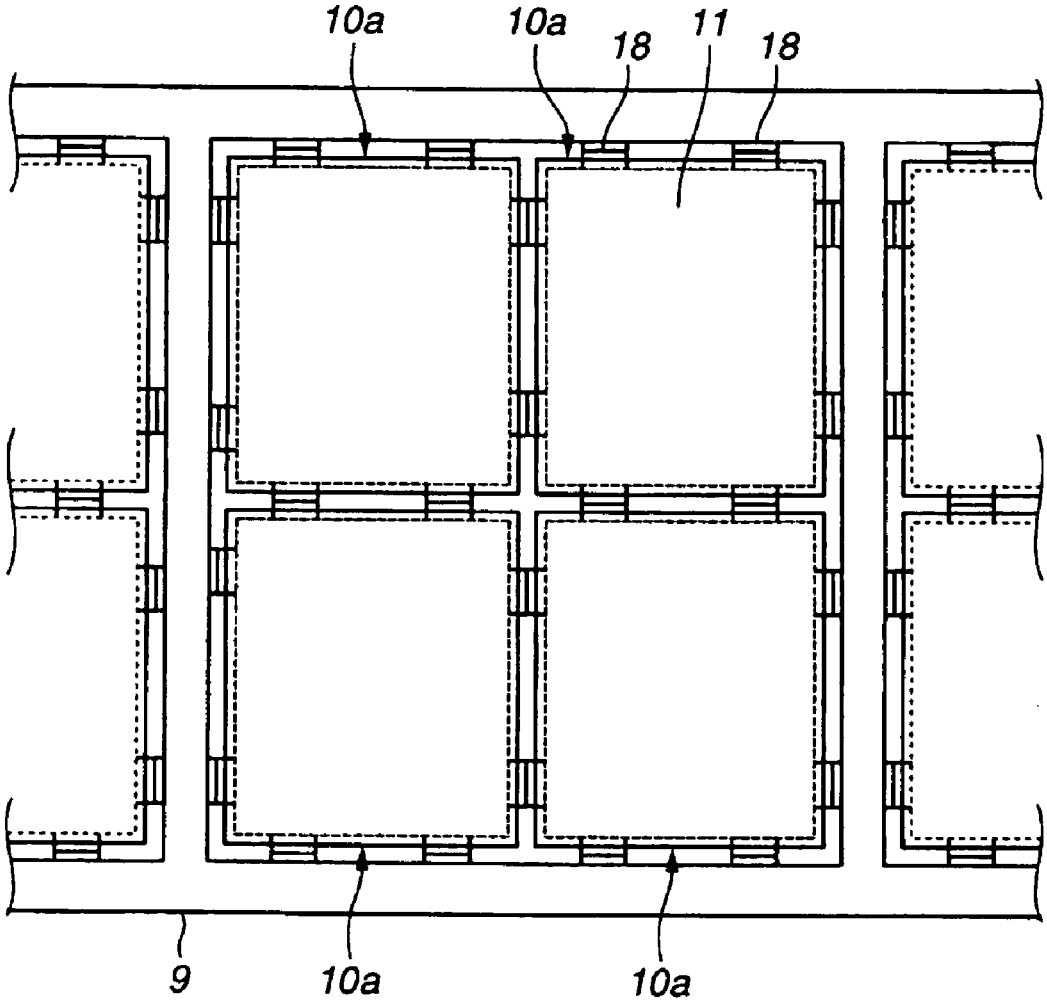
FIG. 6 is a plan view of one working station.

FIG. 6 is a plan view of one working station, showing a mode different from that of FIG. 4.

In FIG. 6, the die cushion modules 10*a* are directly adjacent to each other with the guide plates 18 between them. According to this structure, it is not necessary to consider the vertical rib of the bed 9, so that the flexibility of arrangement of the die cushion module 10*a* is increased. The production cost can be prevented from increasing because the vertical rib of the bed 9 is not required. Besides, the top plate of the cushion pad 11 becomes unnecessary. But, in the structure shown in FIG. 6, the looseness of cushion plates 18 increases to some extent in comparison with the structure shown in FIG. 4.

The individual die cushion modules 10*a* are independently controlled. Therefore, a cushion pressure in one working station becomes variable. And, the individual die cushion modules 10*a* can be synchronized.

When a case where a single cushion pad provided with plural drive mechanisms is disposed on one working station and its operation is controlled and a case where plural cushion pads each provided with a single drive mechanism are disposed on one working station and their operations are controlled are compared, the latter has better independent controllability because the cushion pads are divided.

According to the first embodiment, the die cushion modules 10*a* can be disposed and combined freely, and design flexibility is increased. Therefore, it becomes easy to design the die cushion 10. The number of part types is decreased through the miniaturization of the die cushion module 10*a*, and the management cost of parts is reduced. And, the bottom end of the drive mechanism is not displaced regardless of the vertical operation of the cushion pad 11. Therefore, it is not necessary to suspend a protective cover from the bottom surface of the bed, and it is not necessary to increase a pit depth for the die cushion.

SECOND EMBODIMENT

The structure of a second embodiment has many points which agree with those of the structure of the first embodiment. But, the nut side of the ball screw rotates and the thread side moves linearly in the first embodiment, but the thread side of the ball screw rotates and the nut side moves linearly in the second embodiment.

Figure 7:
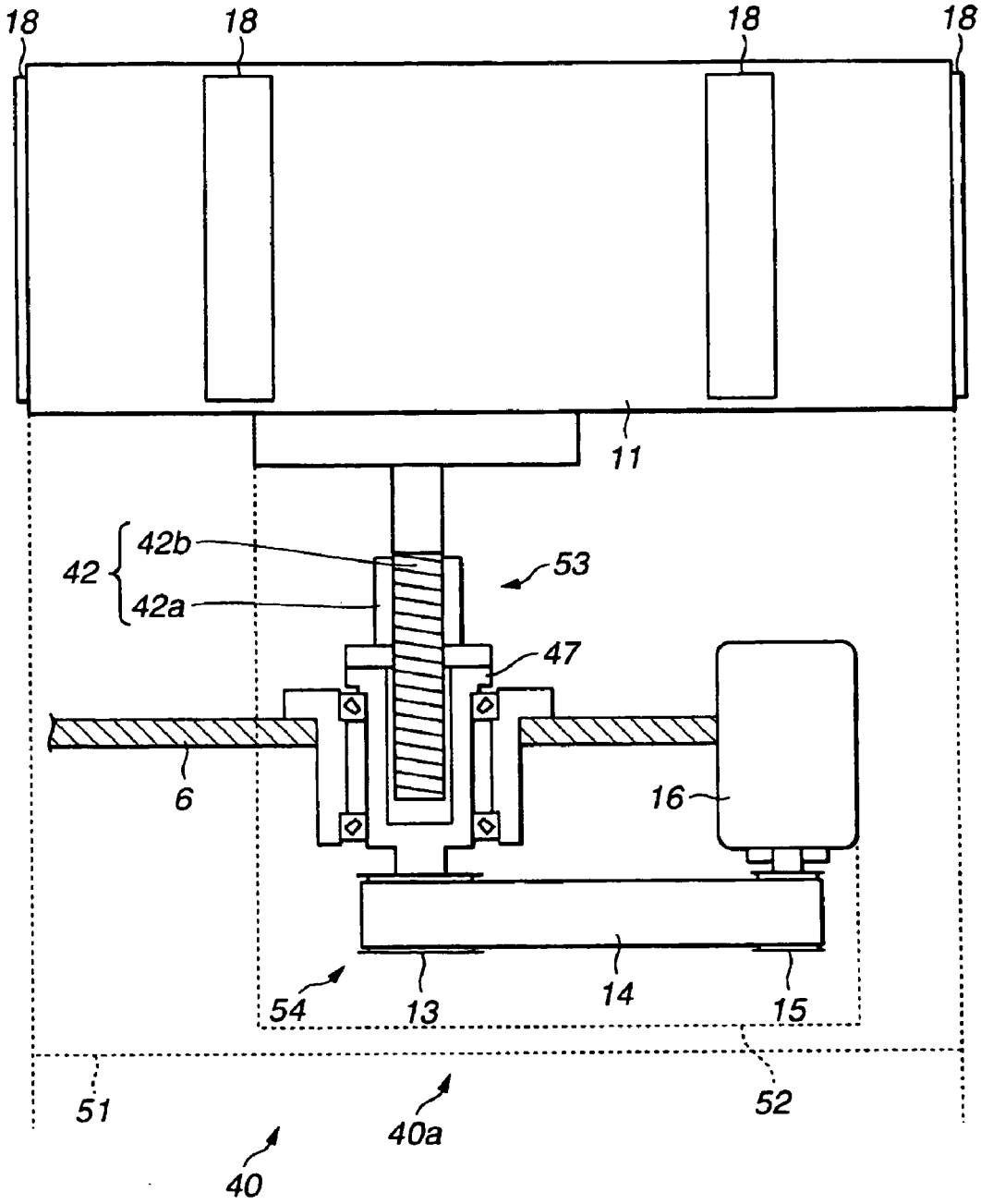
FIG. 7 is a schematic view of a die cushion according to a second embodiment.

FIG. 7 is a schematic view of the die cushion according to the second embodiment.

In a die cushion module 40*a*, the cushion pad 11 is coupled to the rotation shaft of the servomotor 16 via a ball screw 42, a coupling member 47, the large pulley 13, the belt 14 and the small pulley 15. The power is mutually transferable between the cushion pad 11 and the servomotor 16. A thread portion 42*b* of the ball screw 42 is coupled to the lower part of the cushion pad 11. The thread portion 42*b* of the ball screw 42 is screwed into a nut portion 42*a*. The lower part of the nut portion 42*b* is connected to the coupling member 47. The coupling member 47 is rotatably supported in the beam 6 by a bearing or the like, and its lower part is coupled to the large pulley 13. The small pulley 15 is connected to the rotation shaft of the servomotor 16. The belt 14 is wound around the large pulley 13 and the small pulley 15 to make the power transferable between them.

When the servomotor 16 is supplied with an electric current to rotate the rotation shaft, the small pulley 15, the large pulley 13, the coupling member 47 and the nut portion 42*a* are rotated. With the rotary motion of the nut portion 42*a*, the thread portion 42*b* is moved linearly in the vertical direction along the nut portion 42*a*, namely in the up and down directions. Then, the cushion pad 11 moves up and down together with the thread portion 42*b*. The bottom end of the thread portion 42*b* is held higher than the bottom end of the coupling member 47 regardless of the up and down movements of the thread portion 42*b*. A pushing force given to the cushion pad 11, namely a cushion pressure produced in the cushion pad 11, is controlled by controlling the electric current to the servomotor 16.

In this embodiment, the mechanism which converts the rotary motion of the servomotor 16 into a linear movement of the cushion pad 11 and is related to the linear movement of the cushion pad 1, namely the ball screw 42 is called a power conversion mechanism 53. The mechanisms which transfer the rotary motion of the servomotor 16 to the power conversion mechanism 53, namely the coupling member 47, the large pulley 13, the belt 14 and the small pulley 15 are called a power transmission mechanism 54.

The guide plates 18 are disposed on the individual sides of the cushion pads 11. It is not shown but the guide plates 18 are also disposed on the inside wall surfaces of the bed 9 and mutually slidable with the guide plates 18 on the cushion pad 11. When two cushion pads 11 are adjacent to each other with their sides opposed to each other, the individual guide plates 18 are mutually slidable. Thus, the cushion pad 11 is guided in the up and down directions by the guide plates which are disposed on four sides of the cushion pad 11.

Then, the positional relationships of the drive mechanism which is comprised of the cushion pad 11, the servomotor 16 and the like will be described.

First, it is assumed that a first projected image 51 is formed by projecting from vertically above of the cushion pad 11 to a lower horizontal surface. It is also assumed that a second projected image 52 is formed by projecting from vertically above of the servomotor 16, the power conversion mechanism 53 and the power transmission mechanism 54 to a lower horizontal surface. And, the cushion pad 11 and its drive mechanism are arranged such that the second projected image 52 is entirely included in the first projected image 51. By arranging in this way, a *mounting space* in the horizontal direction of the die cushion module 40*a* does not become larger than the top surface area of the cushion pad 11. In other words, even if the cushion pads 11 are disposed adjacent to each other, the drive mechanisms below the individual cushion pads 11 do not interfere with each other, and it becomes possible to dispose the plural die cushion modules 40*a* next to one working station.

In FIG. 7, if the downward projected images of the servomotor 16, the belt 14 and the small pulley 15 are outside of the first projected image 51, the adjacent die cushion modules 40*a* can be disposed closer to each other by varying the height of the belt 14 or exchanging the positions of the servomotors 16. Thus, the area of the cushion pad 11 of the individual die cushion modules 40*a* can be decreased furthermore, the arrangement of the die cushion modules 40*a* is facilitated, and the arrangement flexibility is increased.

The die cushion module 40*a* is disposed as shown in FIG. 4 and FIG. 6 in the same manner as the die cushion module 10*a* of the first embodiment.

According to the second embodiment, the same effect as in the first embodiment can be obtained.

THIRD EMBODIMENT

Figure 8:
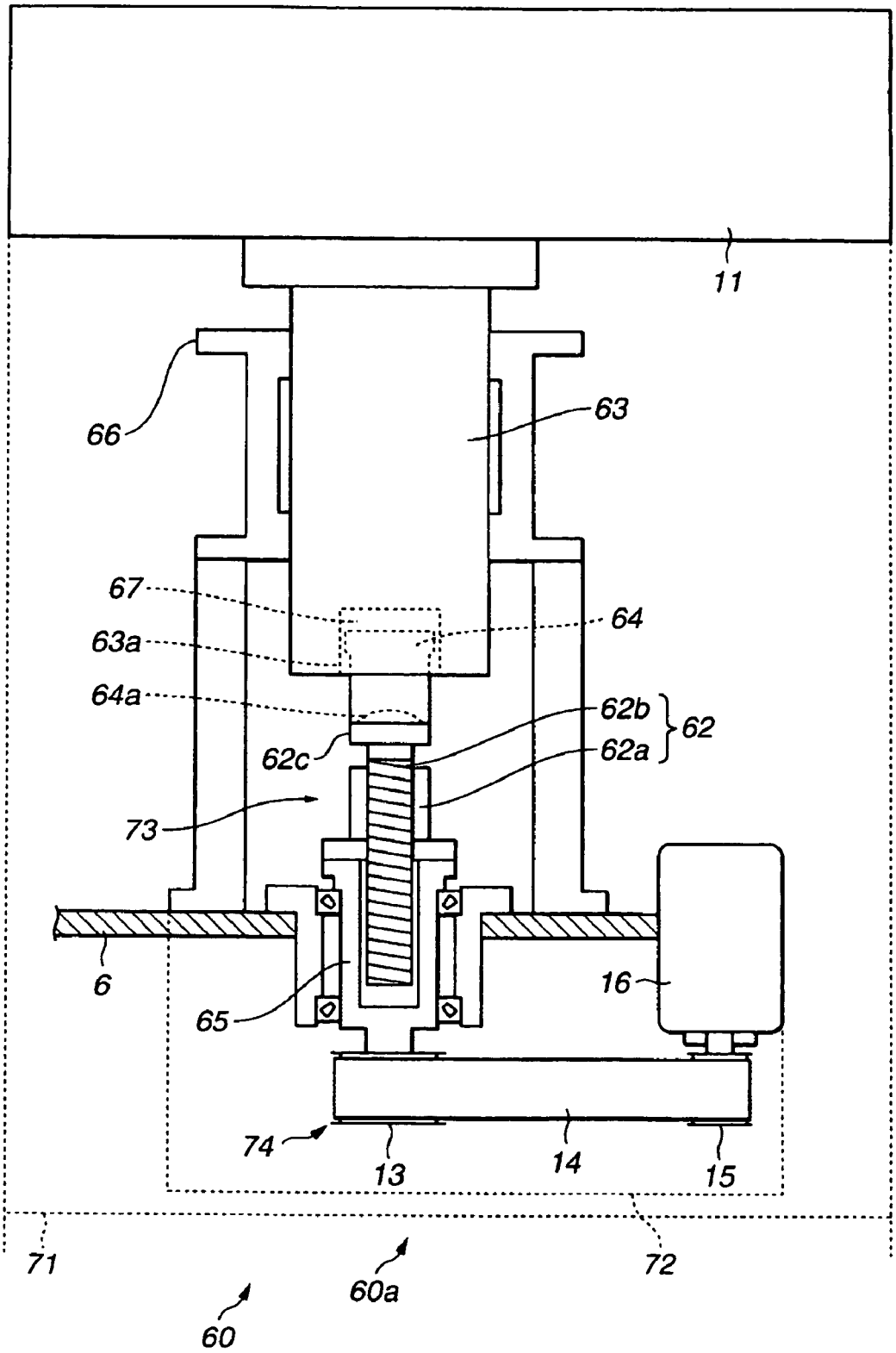
FIG. 8 is a schematic view of a die cushion according to a third embodiment.

FIG. 8 is a schematic view of the die cushion according to a third embodiment.

In a die cushion module 60*a*, the cushion pad 11 is coupled to the rotation shaft of the servomotor 16 via a plunger rod 63, a piston 64, a ball screw 62, a coupling member 65, the large pulley 13, the belt 14 and the small pulley 15. The power is mutually transferable between the cushion pad 11 and the servomotor 16.

The columnar plunger rod 63 is connected to the lower part of the cushion pad 11. The plunger rod 63 is slidably supported its side surface by a cylindrical plunger guide 66. The plunger guide 66 is attachable to the beam 6. When the plunger guide 66 is fixed to the beam 6, the plunger rod 63 moves up and down while being supported by the plunger guide 66. The plunger guide 66 guides the plunger rod 63 and the cushion pad 11 which is coupled to the plunger rod 63 in the up and down directions.

A cylinder 63*a* which has an opening downward is formed in a lower part of the plunger rod 63, and the piston 64 is slidably housed in the cylinder 63*a*. A hydraulic chamber 67 is comprised of the inside wall surface of the cylinder 63*a* and the top surface of the piston 64, and the hydraulic chamber 67 is filled with a pressure oil. The center of axis of the hydraulic chamber 67 agrees with the center of axis of the plunger rod 63 and the ball screw 62. A pressure oil port of the hydraulic chamber 67 is connected to an unshown hydraulic circuit, and the pressure oil is given and received between the hydraulic chamber 67 and the hydraulic circuit. The pressure oil of the hydraulic chamber 67 lessens an impact produced when the upper die and the work are contacted and is discharged to a tank when the hydraulic pressure becomes a prescribed value or more. The pressure oil of the hydraulic chamber 67 has such an excessive load protective function.

The bottom end of the piston 64 is in contact with the top end of the thread portion 62*b* of the ball screw 62. A spherical concave 64*a* is formed in the bottom end of the piston 64, and a spherical convex 62*c* is formed on the top end of the thread portion 62*b* which is opposed to the concave 64*a*. Conversely, a convex may be formed on the bottom end of a piston 68, and a concave may be formed in the top end of the thread portion 62*b*. A rod-shaped member such as the thread portion 62*b* is strong against the force in the axial direction which acts on the end portion but weak against a bending moment. When the top end of the thread portion 62*b* has a spherical shape, only the force in the axial direction acts on the entire thread portion 62*b* even if the cushion pad 11 is inclined and a bending moment is produced on the top end of the thread portion 62*b*. By configuring in this way, the thread portion 62*b* can be prevented from being damaged by an eccentric load.

The coupling member 65 is interposed between the nut portion 62*a* of the ball screw 62 and the large pulley 13 and rotatably supported in the coupling member 65 by a bearing or the like. The small pulley 15 is connected to the rotation shaft of the servomotor 16. The belt 14 is wound around the large pulley 13 and the small pulley 15, and the power is mutually transferable between them.

The servomotor 16 is supplied with an electric current, and when the rotation shaft rotates, the small pulley 15 and the large pulley 13 are rotated. The large pulley 13, the coupling member 65 and the nut portion 62*a* are integral, so that the nut portion 62*a* is rotated when the large pulley 13 rotates. The thread portion 62*b* is linearly moved in the vertical direction, namely in the up and down directions, along the nut portion 62*a* as the nut portion 62*a* is rotated. The cushion pad 11 is moved up and down together with the thread portion 62*b*, the piston 64 and the plunger rod 63. The bottom end of the thread portion 62*b* is held higher than the bottom end of the coupling member 65 regardless of the up and down movements of the thread portion 62*b*. By controlling an electric current to the servomotor 16, a pushing force given to the cushion pad 11, namely a cushion pressure produced in the cushion pad 11 is controlled.

In this embodiment, mechanisms which convert the rotary motion of the servomotor 16 into the linear movement of the cushion pad 11 and relates to the linear movement of the cushion pad 11, namely the ball screw 62, the plunger rod 63 and the plunger guide 66 are called as a power conversion mechanism 73. Mechanisms which transfer the rotary motion of the servomotor 16 to the power transmission mechanism 73, namely the coupling member 65, the large pulley 13, the belt 14 and the small pulley 15 are called as a power transmission mechanism 74.

Then, the positional relationship of the drive mechanism which is comprised of the cushion pad 11, the servomotor 16 and the like will be described.

First, it is assumed that a first projected image 71 is formed by projecting from vertically above of the cushion pad 11 to a lower horizontal surface. It is also assumed that a second projected image 72 is formed by projecting from vertically above of the servomotor 16, the power conversion mechanism 73 and the power transmission mechanism 74 to a lower horizontal surface. And, the cushion pad 11 and its drive mechanism are arranged such that the second projected image 72 is entirely included in the first projected image 27. By arranging in this way, a *mounting space* in the horizontal direction of the die cushion module 60*a* does not become larger than the top surface area of the cushion pad 11. In other words, even if the cushion pads 11 are disposed adjacent to each other, the drive mechanisms below the individual cushion pads 11 do not interfere with each other, and it becomes possible to dispose the plural die cushion modules 60*a* next to one working station.

In FIG. 8, if the downward projected images of the servomotor 16, the belt 14 and the small pulley 15 are outside of the first projected image 71, the adjacent die cushion modules 60*a* can be disposed closer to each other by varying the height of the belt 14 or exchanging the positions of the servomotors 16. Thus, the area of the cushion pad 11 of the individual die cushion modules 60*a* can be decreased furthermore, the arrangement of the die cushion modules 60*a* is facilitated, and the arrangement flexibility is increased.

Here, the arrangement of the die cushion modules 60*a* will be described with reference to a case where four die cushion modules 60*a* are disposed on one working station.

Figure 9:
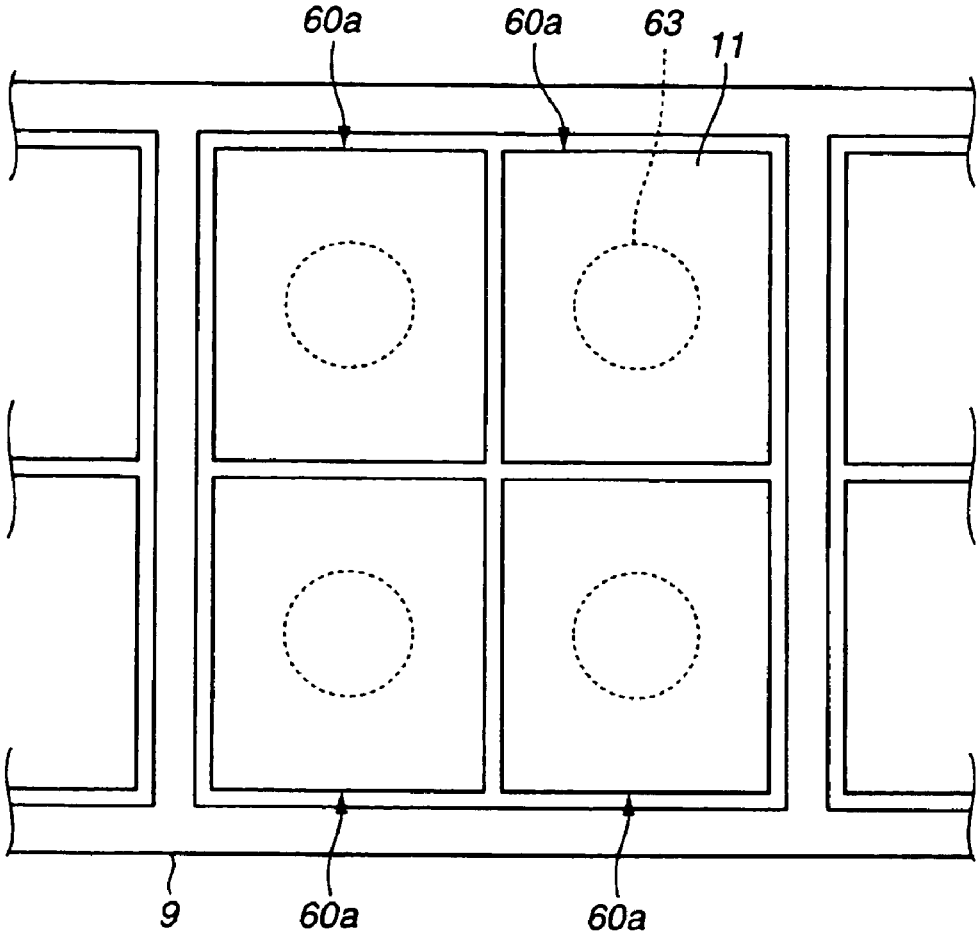
FIG. 9 is a plan view of one working station.

FIG. 9 is a plan view of one working station.

In the die cushion module 60*a*, the plunger guide 66 functions as the guide member. As shown in FIG. 9, the guide plates are not required on the side surfaces of the cushion plate 11. By configuring in this way, the flexibility of the arrangement of the die cushion modules 60*a* is increased furthermore. Machining of the guide plate portion becomes unnecessary, so that the production cost can be suppressed from increasing. But, the die cushion module itself becomes long by a length of the plunger rod 63.

According to the third embodiment, the same effects as in the first embodiment can be obtained. And, it is not necessary to dispose the guide plates on the side surfaces of the cushion pad 11, and the flexibility related to the arrangement of the die cushion module 60*a* increases.

FOURTH EMBODIMENT

Figure 10:
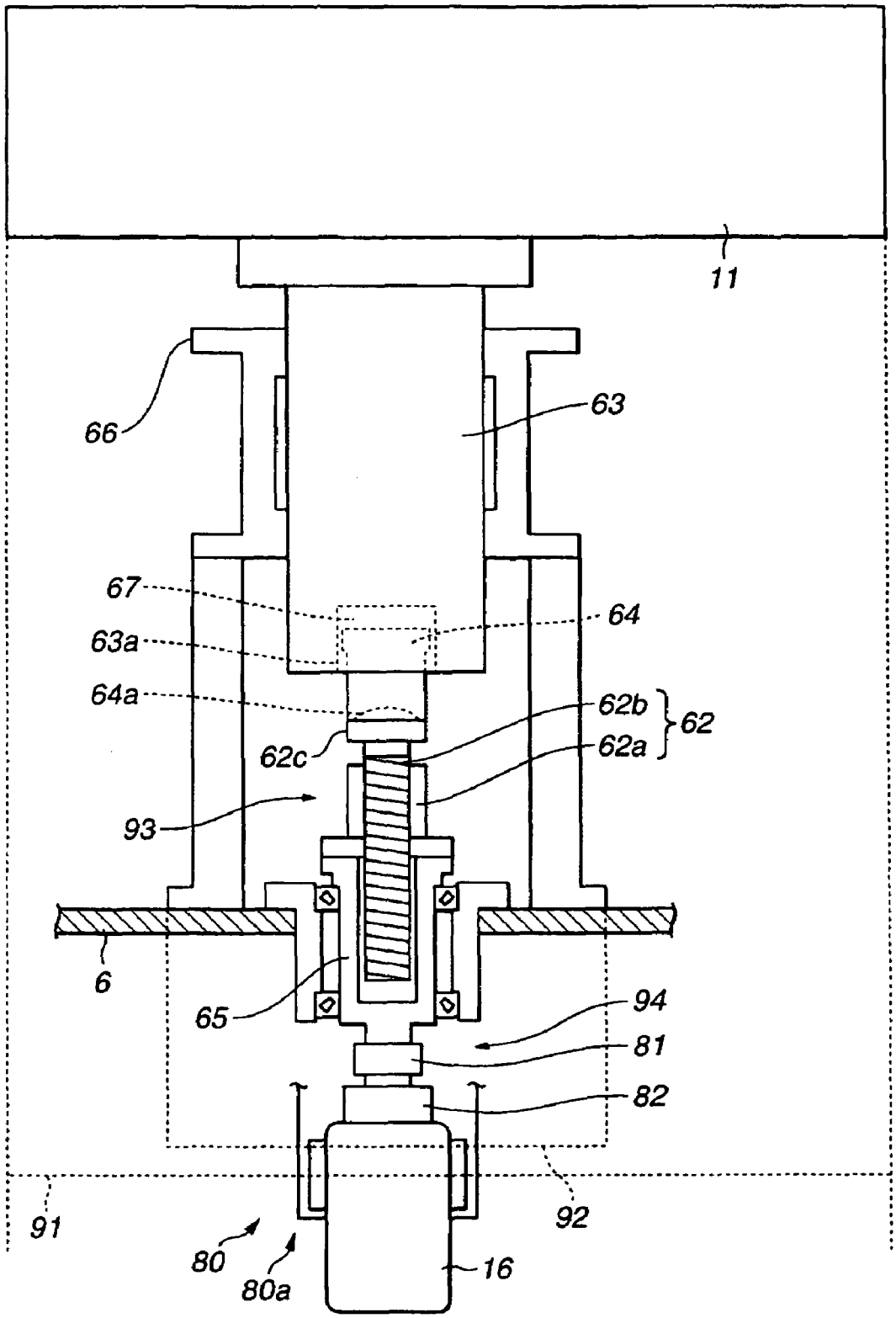
FIG. 10 is a schematic view of a die cushion according to a fourth embodiment.

FIG. 10 is a schematic view of the die cushion according to a fourth embodiment.

The structure of the fourth embodiment has many common points as those in the structure of the third embodiment. Therefore, differences only will be described below.

In a die cushion module 80*a*, the cushion pad 11 is directly connected to the rotation shaft of the servomotor 16 via the plunger rod 63, the piston 64, the ball screw 62, the coupling member 65, a coupling 81 and a reduction gear 82. The power is mutually transferable between the cushion pad 11 and the reduction gear 82.

The coupling member 65 is attached to the lower part of the same shaft of the nut portion 62*a* of the ball screw 62, and the coupling member 65 is rotatably supported in the beam 6 by a bearing or the like. The reduction gear 82 is connected to the rotation shaft of the servomotor 16. The servomotor 16 may have the reduction gear therein. The output shaft of the reduction gear 82 and the coupling member 65 are connected by the coupling 81. Therefore, the ball screw 62, the coupling member 65, the coupling 81 and the output shaft of the reduction gear 82 are positioned on the same axis, and the rotation shaft of the servomotor 16 is also positioned on the same axis depending on the structure of the reduction gear 82.

When the servomotor 16 is supplied with an electric current to rotate the rotation shaft, the gears and the like in the reduction gear 82 rotate, and the output shaft of the reduction gear 82, the coupling 81 and the coupling member 65 are rotated. The coupling member 65 and the nut portion 62*a* are integral, so that the nut portion 62*a* is rotated, the thread portion 62*b* moves linearly in the vertical direction, namely in the up and down directions, along the nut portion 62*a* with the rotation of the nut portion 62*a*. The cushion pad 11 moves up and down together with the thread portion 62*b*, the piston 64 and the plunger rod 63. The bottom end of the thread portion 62*b* is held higher than the bottom end of the coupling member 65 regardless of the up and down movements of the thread portion 62*b*. By controlling the electric current to the servomotor 16, a pushing force given to the cushion pad 11, namely a cushion pressure produced in the cushion pad 11 is controlled.

In this embodiment, the mechanisms which convert the rotary motion of the servomotor 16 into the linear movement of the cushion pad 11 and are related to the linear movement of the cushion pad 11, namely the ball screw 62, the plunger rod 63 and the plunger guide 66, are called as a power conversion mechanism 93. The mechanisms which transfer the rotary motion of the servomotor 16 to the power transmission mechanism 93, namely the coupling member 65, the coupling 81 and the reduction gear 82, are called as a power transmission mechanism 94.

Then, the positional relationship of the drive mechanism which is comprised of the cushion pad 11, the servomotor 16 and the like will be described.

First, it is assumed that a first projected image 91 is formed by projecting from vertically above of the cushion pad 11 to a lower horizontal surface. It is also assumed that a second projected image 92 is formed by projecting from vertically above of the servomotor 16, the power conversion mechanism 93 and the power transmission mechanism 94 to a lower horizontal surface. And, the cushion pad 11 and its drive mechanism are arranged such that the second projected image 92 is entirely included in a first projected image 97. By arranging in this way, a *mounting space* in the horizontal direction of the die cushion module 80*a* does not become larger than the top surface area of the cushion pad 11. In other words, even if the cushion pads 11 are disposed adjacent to each other, the drive mechanisms below the individual cushion pads 11 do not interfere with each other, and it becomes possible to dispose the plural die cushion modules 80*a* next to one working station.

By configuring as described above, the drive mechanisms below the individual cushion pads 11 do not interfere with each other even if the cushion pads 11 are disposed adjacent to each other. Thus, the plural die cushion modules 80*a* can be disposed adjacent to one working station.

Because the drive mechanisms are disposed on substantially the same axis, the projected image of the drive mechanism which is assumed when projected from vertically above to a lower horizontal surface becomes small. Therefore, the cushion pad 11 itself can be made small. And, the combination of the die cushion modules 80*a* becomes easier.

The die cushion modules 80*a* are arranged in the same manner as the die cushion module 60*a* of the third embodiment as shown in FIG. 9.

According to the fourth embodiment, the same effects as in the third embodiment can be obtained. Especially, the cushion pad 11 can be made smaller than in the third embodiment, and the flexibility of the arrangement of the die cushion modules 80*a* is increased furthermore.

What is claimed is:

1. A die cushion device, comprising a unitized die cushion module, the unitized die cushion module including:

a cushion pad moving up and down in a vertical direction within a bed;

a servomotor rotating a shaft;

a power transmission mechanism transferring the rotating motion from the rotating shaft of the servomotor to a power conversion mechanism;

the power conversion mechanism converting the rotating motion from the shaft of the servomotor into the up and down movements in the vertical direction of the cushion pad, the power conversion mechanism including a rotating member having a rotating axis extending in the vertical direction; and a guide member which guides the cushion pad in the up and down directions, wherein the shaft of the servomotor extends in the vertical direction, and wherein one working station of the bed is provided with one or more of the die cushion module.

2. The die cushion device according to claim 1, wherein a rib is disposed between the opposite wall surfaces of the one working station, and cushion pads are adjacent to each other with the rib between the cushion pads.

3. The die cushion device according to claim 1, wherein, the power conversion mechanism includes a nut portion and a thread portion.

4. The die cushion device according to claim 3, wherein the nut portion rotates and the thread portion moves in the vertical direction.

5. The die cushion device according to claim 3, wherein the thread portions rotates and the nut portion moves in the vertical direction.

6. A die cushion device, comprising a unitized die cushion module, the unitized die cushion module including:

a cushion pad moving up and down in a vertical direction within a bed;

a servomotor rotating a shaft;

a power transmission mechanism transferring the rotating motion from the rotating shaft of the servomotor to a power conversion mechanism;

the power conversion mechanism converting the rotating motion from the shaft of the servomotor into the up and down movements in the vertical direction of the cushion pad; and a guide member which guides the cushion pad in the up and down directions, wherein the servomotor, the shaft of the servomotor, the power transmission mechanism and the power conversion mechanism fit within the footprint of the cushion pad, and the power conversion mechanism includes a rotation member having a rotating axis extending in the vertical direction.

7. The die cushion device according to claim 6, wherein the shaft of the servomotor extends in the vertical direction.

8. The die cushion device according to claim 6, wherein one working station of the bed is provided with one or more of die cushion pads of the die cushion module, and a rib is disposed between opposite wall surfaces of the one working station, and cushion pads are adjacent to each other with the rib between the cushion pads.

9. A die cushion device, comprising a unitized die cushion module, the unitized die cushion module including:

a cushion pad moving up and down in a vertical direction within a bed;

a servomotor rotating a shaft;

a power transmission mechanism transferring the rotating motion from the rotating shaft of the servomotor to a power conversion mechanism;

the power conversion mechanism converting the rotating motion from the shaft of the servomotor into the up and down movements in the vertical direction of the cushion pad; and a guide member which guides the cushion pad in the up and down directions, wherein the servomotor, the shalt of the servomotor, the power transmission mechanism and the power conversion mechanism fit within the footprint of the cushion pad, the power conversion mechanism includes a rotation member having a rotating axis extending in the vertical direction, and the shaft of the servomotor extends in the vertical direction.

* * * * *